US009433333B2

(12) United States Patent
Colangelo

(10) Patent No.: US 9,433,333 B2
(45) **Date of Patent: *Sep. 6, 2016**

(54) DUSTER WITH INTERIOR SLEEVE

(71) Applicant: Joseph M Colangelo, Boca Raton, FL (US)

(72) Inventor: Joseph M Colangelo, Boca Raton, FL (US)

(73) Assignee: EZ PRODUCTS OF SOUTH FLORIDA, L.L.C., Boca Raton, FL (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/933,837

(22) Filed: Nov. 5, 2015

(65) Prior Publication Data

US 2016/0051114 A1 Feb. 25, 2016

Related U.S. Application Data

(63) Continuation of application No. 13/922,247, filed on Jun. 20, 2013, now Pat. No. 9,204,777.

(51) Int. Cl.
*A47L 13/20* (2006.01)
*A47L 13/16* (2006.01)
*A47L 13/38* (2006.01)

(52) U.S. Cl.
CPC ..... *A47L 13/16* (2013.01); *A47L 13/38* (2013.01)

(58) Field of Classification Search
CPC ..... A47L 13/20; A47L 13/24; A47L 13/38
USPC ..... 15/147.1, 209, 210.1, 208
See application file for complete search history.

(56) References Cited

U.S. PATENT DOCUMENTS

| | | | | |
|---|---|---|---|---|
| 6,047,435 | A * | 4/2000 | Suzuki | A47L 13/20 15/228 |
| 7,251,851 | B2 * | 8/2007 | Lin | A47L 13/16 15/209.1 |
| 7,302,730 | B2 * | 12/2007 | Tanaka | A47L 13/20 15/209.1 |
| 7,571,510 | B2 * | 8/2009 | Yamada | A47L 13/20 15/209.1 |
| 7,870,635 | B2 * | 1/2011 | Yamada | A47L 13/18 15/208 |
| 8,151,398 | B2 * | 4/2012 | Tsuchiya | A47L 13/46 15/209.1 |
| 8,151,402 | B2 * | 4/2012 | Takabayashi | A47L 13/20 15/209.1 |
| 8,186,001 | B2 * | 5/2012 | Tsuchiya | A47L 13/24 15/208 |
| 8,225,453 | B2 * | 7/2012 | Yamada | A47L 13/12 15/209.1 |
| 2006/0016036 | A1 * | 1/2006 | Tanaka | A47L 13/20 15/226 |
| 2006/0282969 | A1 * | 12/2006 | Yamada | A47L 13/18 15/208 |
| 2012/0311803 | A1 * | 12/2012 | Yamada | A47L 13/255 15/209.1 |

FOREIGN PATENT DOCUMENTS

| | | | | |
|---|---|---|---|---|
| WO | WO 2008097537 | A1 * | 8/2008 | A47L 13/20 |

* cited by examiner

*Primary Examiner* — Michael Jennings
(74) *Attorney, Agent, or Firm* — Smith Tempel Blaha LLC; Gregory Scott Smith

(57) ABSTRACT

A duster including a sleeve and one or more fibrous bundles attached to the sleeve. The sleeve is constructed to include one or more channels within the interior of the sleeve for receiving prongs of a duster handle. The fibrous bundles are attached to the surface of the sleeve or through the sleeve. The channels within the sleeve may include one or more narrowing areas to facilitate retention of the prongs within the sleeve.

20 Claims, 15 Drawing Sheets

DUSTER WITH INTERIOR SLEEVE

BACKGROUND

The present application relates to cleaning cloths and, more particularly to a one or two sided duster that includes an interior sleeve for receiving a handle or other holding element.

Certainly, making a mess is much more entertaining than cleaning one up—especially if you are not the mess maker. And further, the concept of delayed gratification cannot be employed in the making of a mess and cleaning it up scenario as, the cleaning must always follow the messing. And so, many devices have been introduced to help reduce the work involved in the cleaning up of a mess compared to making one.

Various cleaning devices, equipment, tools, and the like have been introduced as a goal to help reduce the time and effort in cleaning, as well as in improving the efficiency of the effort applied. One such technological advancement has been in the area of cleaning cloths that can be used by hand or attached to an appliance. A wide variety of such cleaning cloths have been introduced including cloths with scrubbing strips, polishing cloths, cloths impregnated with cleaning solutions, cloths that are highly absorbent, etc. In addition, a wide variety of materials have been used in the construction of such cloths, including cotton, compressed cotton, non-woven fabrics, fiber enriched paper material, etc. Such cleaning cloths have been made as single-use disposable cloths, multiple-use disposable cloths, and cleanable-reusable cloths. In addition, cloths have been made with varying textures, surfaces, etc. to help facilitate the cleaning process.

BRIEF SUMMARY

The present disclosure presents various embodiments of a re-usable and/or disposable duster, as well as features and aspects thereof. In general, the duster includes a sleeve and one or more fibrous bundles attached to the exterior of the sleeve.

In one embodiment, the sleeve is constructed from two sheets that are substantially the same size and shape. The two sheets than can be joined together along the edges, or proximate to the edges, while leaving at least a portion of one edge open. As such, the two sheets, when joined in this manner, create a pocket or sleeve that can then receive a prong or extension of a handle into its interior. Further, fibrous bundles can be attached to one or more of the exterior surfaces of the sleeve to create the duster.

In some embodiments, the sleeve may be constructed of two or more sheets that are attached to each other to form the sleeve or pocket. In other embodiments, the sleeve can be constructed from a single sheet that is folded over itself, and then connected to itself on one or more sides to form the sleeve or pocket. Even further, the sleeve may include multiple layers of different materials to provide strength or firmness to the duster cloth. Yet even further, the sleeve may be constructed of a single cloth tube that may then be closed on one side to form the sleeve or remain open on both sides. These and other embodiments are move fully disclosed in the detailed description.

More particularly, in one embodiment of the duster, two similarly sized, substantially rectangular sheets are joined together by a first joint that runs longitudinally down the center, or proximate to the center, of the sheets and then an additional joint on each side of the center joint and running substantially parallel with the center line. These joints operate to not only join the sheets together, but to also create two channels for receiving prongs of a duster handle. On one end, the sheets are further joined together such that a sleeve is created with an opening on one end. This opening provides access to the channels on the interior of the sleeve. The side joints may flare away from the center joint proximate to the opening so as to widen the access point to the two channels. Fibrous bundles may then be joined to the surface of the sleeve by laying the fibers of the fibrous bundle across the surface of one side of the sleeve such that the fibers extend from one side to the next side of the sleeve. Then, a joint can be used to attach the fibers to the sleeve by extending through the fibers and adhering to the surface of the sleeve. This can be repeated for the opposing side of the sleeve. In addition, at various lengths from the center of the fibers, and including different groups or sets of the fibers, additional joints or tacking joints can be created to connect the fibers to the sleeve. For instance, the fibers can be several fibers in depth and the tacking joint can be used to attach fibers existing at an increasingly lower depth relative to the distance of the tacking joint from the center joint.

Advantageously, such a specific embodiment, which only presents one possible embodiment and does not limit the scope of the invention, results in a duster that can receive a two pronged handle and includes fibrous bundles on both sides of the duster.

These and other embodiments will be more fully described in connection with the drawings and in the detailed description.

DETAILED DESCRIPTION OF VARIOUS EMBODIMENTS

The present invention, as well as features and aspects thereof, is directed towards providing a cleaning cloth, or more particularly a duster, that can be used with or without implements for removing dust or debris from a surface.

In general, embodiments of the duster include at least two fibrous bundles, located on and attached to opposing sides of a sleeve. The sleeve is constructed to include at least one opening for receiving a portion of a handle device that can be used to manipulate and maneuver the duster. An embodiment that includes fibrous bundles on each side of the sleeve is referred to herein as the 360-degree duster embodiment. However, other embodiments may include one or more fibrous bundles located on only one side of the sleeve. In addition, in any of the embodiments, as well as variants thereof, one or more sides of the sleeve may include multiple fibrous bundles having fibers of similar or varying lengths, and constructed of varying materials.

In some embodiments, the sleeve may be constructed of two or more sheets that are attached to each other to form the sleeve or pocket. In other embodiments, the sleeve can be constructed from a single sheet that is folded over itself, and then connected to itself on one or more sides to form the sleeve or pocket. Even further, the sleeve may include multiple layers of different materials to provide strength or firmness to the duster cloth. Yet even further, the sleeve may be constructed of a single cloth tube that may then be closed on one side to form the sleeve or remain open on both sides.

Turning now to the figures, various examples of embodiments of the duster, as well as variants, features, aspects and elements of such embodiments are presented in more detail.

Figure 1:
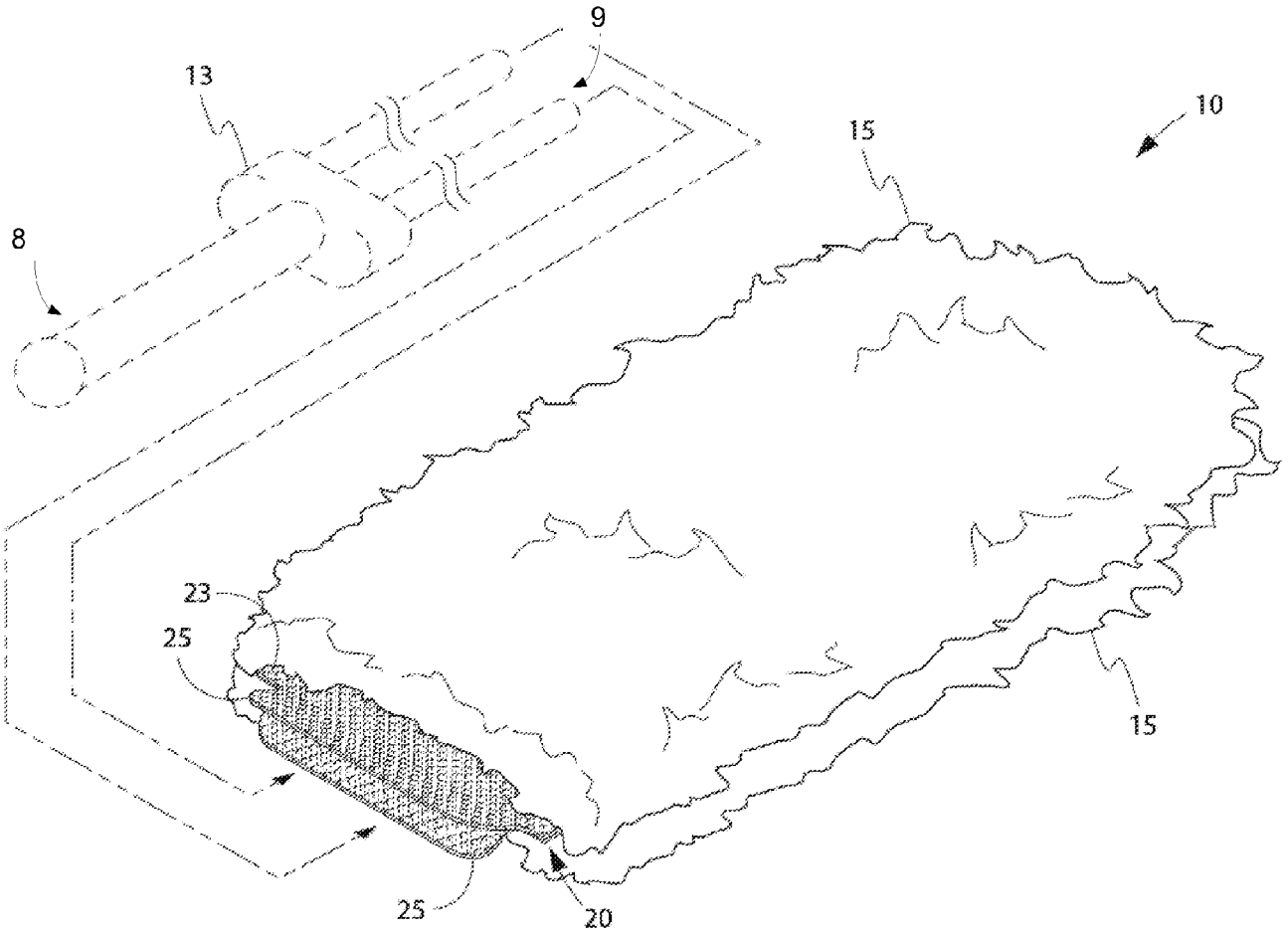
FIG. 1 is a perspective view illustrating an exemplary embodiment of an assembled 360-degree duster.

FIG. 1 is a perspective view illustrating an exemplary embodiment of an assembled 360-degree duster. The duster 10 is shown as including fibrous bundles 15 located on opposing sides of a sleeve 20. In the illustrated embodiment, the sleeve 20 is shown as being entirely within the confines or boundaries of the fibrous bundles 15 except for a receiving end 23. The receiving end 23 includes an opening formed between an upper sheet and a lower sheet of the sleeve 20 and the opening includes two flanges 25 that can be forced open by lifting or pushing them away from each other. The opening of the sleeve 20 at the receiving end 23 is shown as extending slightly beyond the end of the fibrous bundles. To illustrate the receiving end 23 better, the fibrous bundles are shown as being bunched up and pulled away to more clearly reveal the details of the receiving end 23. It will be appreciated that in some embodiments, the receiving end 23 may protrude further out of the end of the fibrous bundles or, may be completely embedded within the fibrous bundles such that the receiving end 23 is slightly short of the edge of the fibrous bundles. A handle 13, which includes a handle end 8 and a pronged end 9 is illustrated as being able to be inserted into the receiving end 23 of the sleeve 20 between the opening created by the two flanges or flaps 25.

Figure 2:
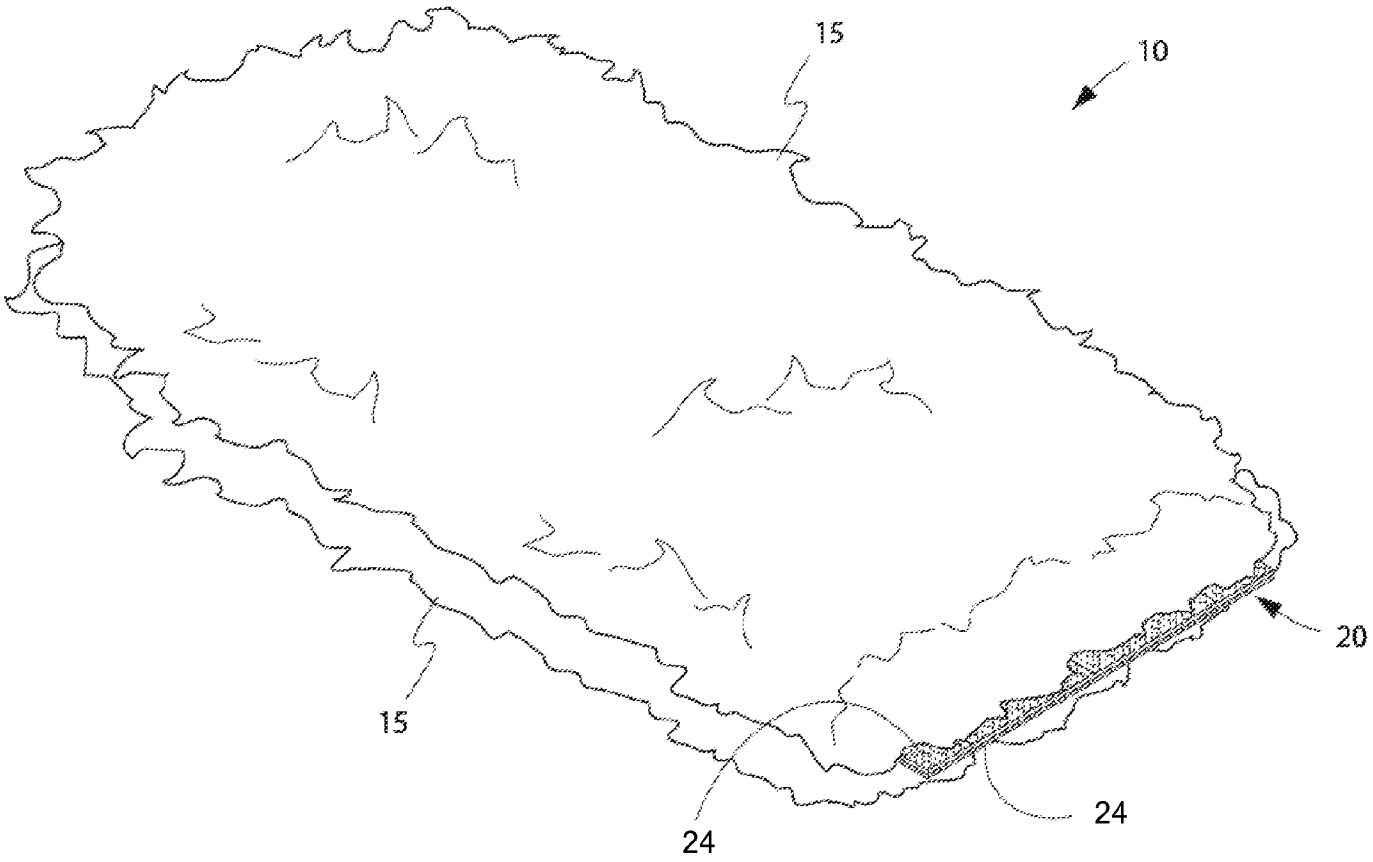
FIG. 2 is a perspective drawing illustrating another view of the exemplary embodiment of the 360-degree duster of FIG. 1.

FIG. 2 is a perspective drawing illustrating another view of the exemplary embodiment of the 360-degree duster of FIG. 1. In the illustrated embodiment, the fibrous bundles 15 of the duster 10 are shown as being pulled back or bunched up to reveal the closed end 24 of the sleeve 20. The closed end 24 is opposite from the receiving end 23 illustrated in FIG. 1. It will be appreciated that although the illustrated embodiment shows that the sleeve 20 is only open on one end, in some embodiments the sleeve 20 may be open on both ends and configured to receive the prongs 9 of a handle 13 on either end.

Figure 3:
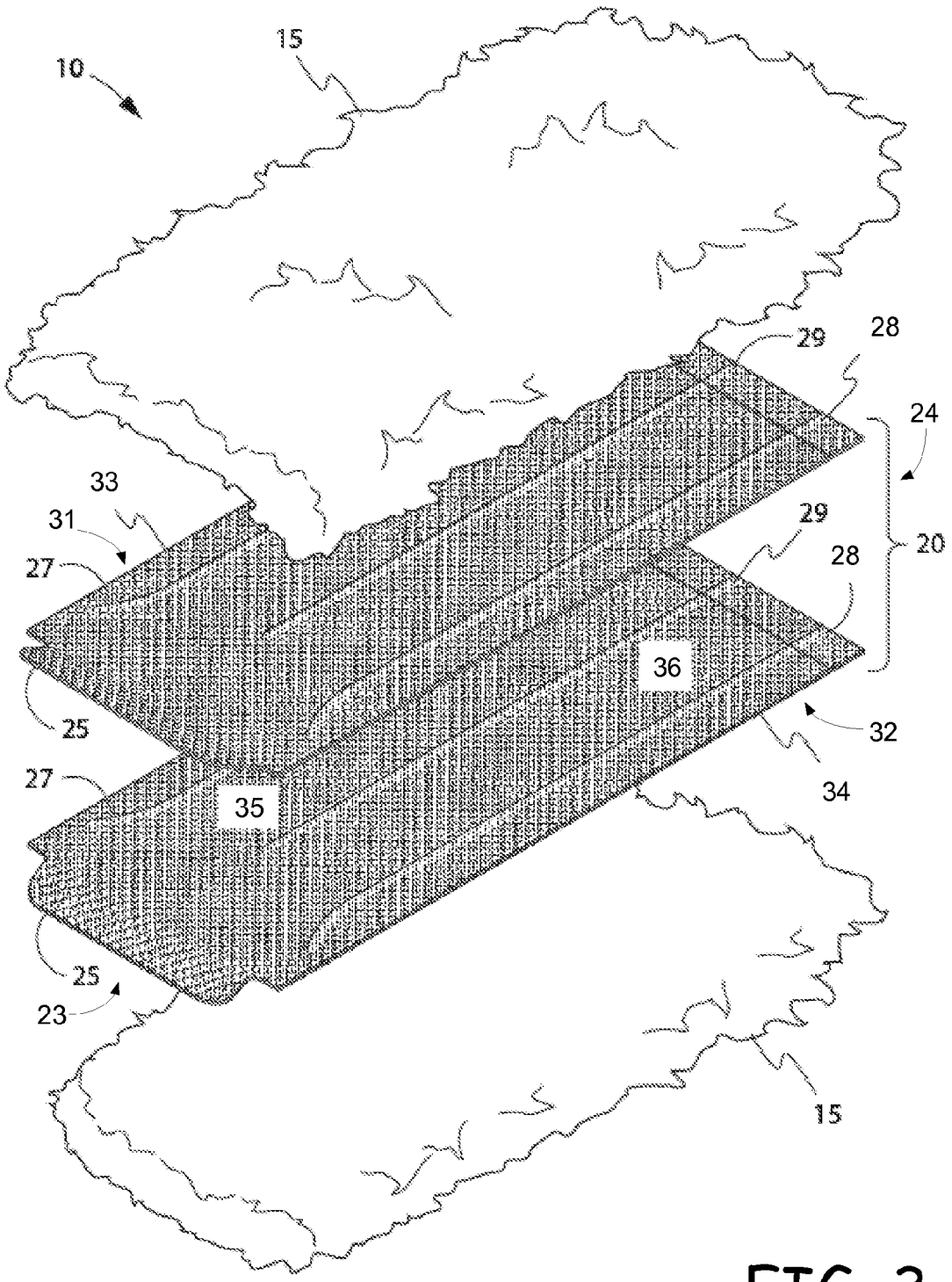
FIG. 3 is an exploded view of the exemplary embodiment of the 360-degree duster of FIG. 1.

FIG. 3 is an exploded view of the exemplary embodiment of the 360-degree duster of FIG. 1. The illustrated duster 10 includes the upper and lower fibrous bundles 15 and the sleeve 20. The sleeve 20 is illustrated as including an upper sheet 31 and a lower sheet 32. When the upper sheet 31 is joined to the lower sheet 32, the sleeve is created. Depending upon the particular configuration, the sleeve 20, once formed, defines the opening located at the receiving end 23 and a closed end 24. The upper sheet 31 and the lower sheet 32 can be connected or joined to each other using a variety of techniques. A few non-limiting examples of techniques to join the upper sheet 31 and the lower sheet 32 include welding, heat fusing, adhesives, stitching as well as combinations of these techniques and/or other techniques. In the illustrated embodiment, applying heat to melt, or partially melt, portions of the sheets together, creates the fusion welds. As such, fusion weld 27 is used to secure one of the longitudinal edges 33 of sheets 31 and 32 together and weld 28 is used to secure the other longitudinal edge 34 of sheets 31 and 32 together. Weld 29 extends down substantially the longitudinal center of the upper sheet 31 and lower sheet 32 to further fuse the two sheets together. It should be appreciated that although the term "weld" may include a weld created by a heat fusion process, the use of that term within this disclosure may be substituted by any of the other previously-mentioned methods, or other techniques and combinations thereof. However, the term weld will be used through out this description as a generic word to describe any type of joint, or joining connection between materials in the various embodiments of the duster unless specifically indicated otherwise, and should not be limited to any particular technique. Similarly, the terms "joined" or "joint" are used throughout the disclosure for any of the above-referenced techniques for joining the material together and, it should not be limited to any particular technique.

Once the sheets are joined together, the welds 27, 28 and 29 function to create two channels within the sleeve, channel 35 and channel 36, which, as a non-limiting example, can receive the prong portion 9 of the handle 13. The welds 27 and 28 are illustrated as running substantially parallel to the edges 33 and 34 of the upper sheet 31 and lower sheet 32 but, as the welds approach the opening of receiving end 23, the welds flare out away from the center weld 29. In the illustrated embodiment, the flaring of the welds 27 and 28 are shown as an arc but it should be appreciated, that the flare could be an angled line, could be more gradual over the length of the sleeve 20, may be a separate weld from welds 27 and 28 or, even in some embodiments may simply not flare at all. Further, in the illustrated embodiment, the center weld 29 is shown as being shorter in length than the two edge welds 27 and 28.

In addition to the welds 27 and 28, the upper sheet 31 and the lower sheet 32 may also be fused or joined together using any of the above listed techniques and others. For instance, the lip of the sleeve extending from the weld 27 out to the edge 33 can be joined together by any of the above-listed techniques, as well as other techniques and combinations thereof. Similarly, the lip of the sleeve extending from the weld 28 out to the edge 34 can also be joined together by any of the above-listed techniques, as well as other techniques and combinations thereof. In addition, the closed end 24 may be formed by joining the edges of sheet 31 and 32 opposite from the receiving end 23 using any of the above-listed techniques as well as other techniques and combinations thereof Similar to the techniques applied for joining the upper sheet 31 and the lower sheet 32 to form the sleeve 20, the same techniques may be applied for joining the fibrous bundles 15 to the sleeve 20. For example, in the embodiment illustrated in FIG. 3, the welds 27, 28 and 29 may extend from the outer side of one fibrous bundle, through the sleeve 20 and through to the outer side of the other fibrous bundle.

Figure 4:
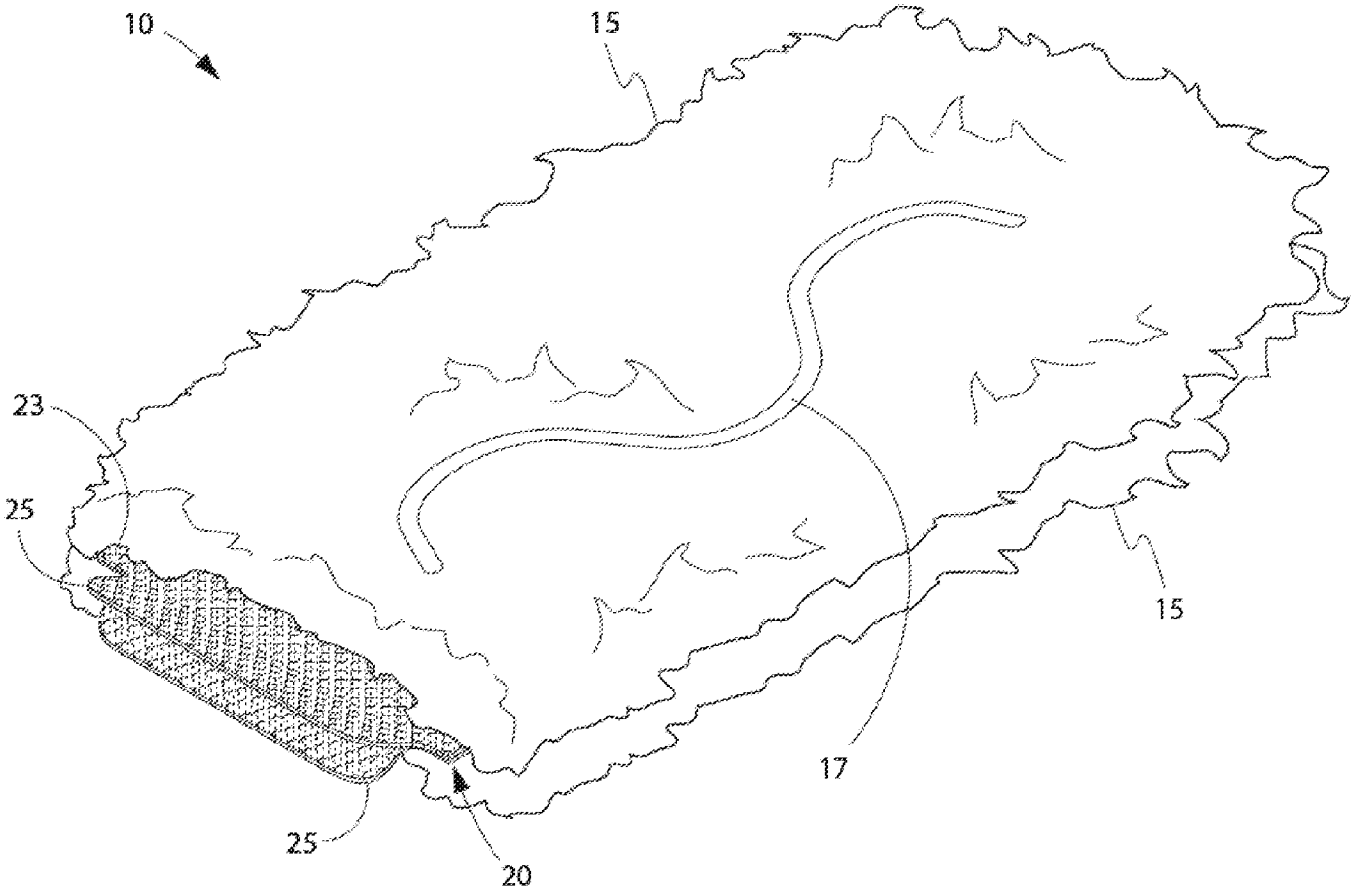
FIG. 4 is a perspective view of the 360-degree duster showing the fibrous bundles as being attached to the sleeve using an additional weld.

FIG. 4 is a perspective view of the 360-degree duster showing the fibrous bundles as being attached to the sleeve using an additional weld. The illustrated weld 17 is shown as being substantial sinusoidal in shape and traversing longitudinally down the center of the fibrous bundles 15 and hence, the sleeve 20. In one embodiment, the fibrous bundle 15 is attached to the upper sheet 31 by simply welding it to the upper surface of the upper sheet 31. Likewise, the fibrous bundle 15 is attached to the lower sheet 32 by simply welding it to the lower surface of the lower sheet 32.

Figure 5:
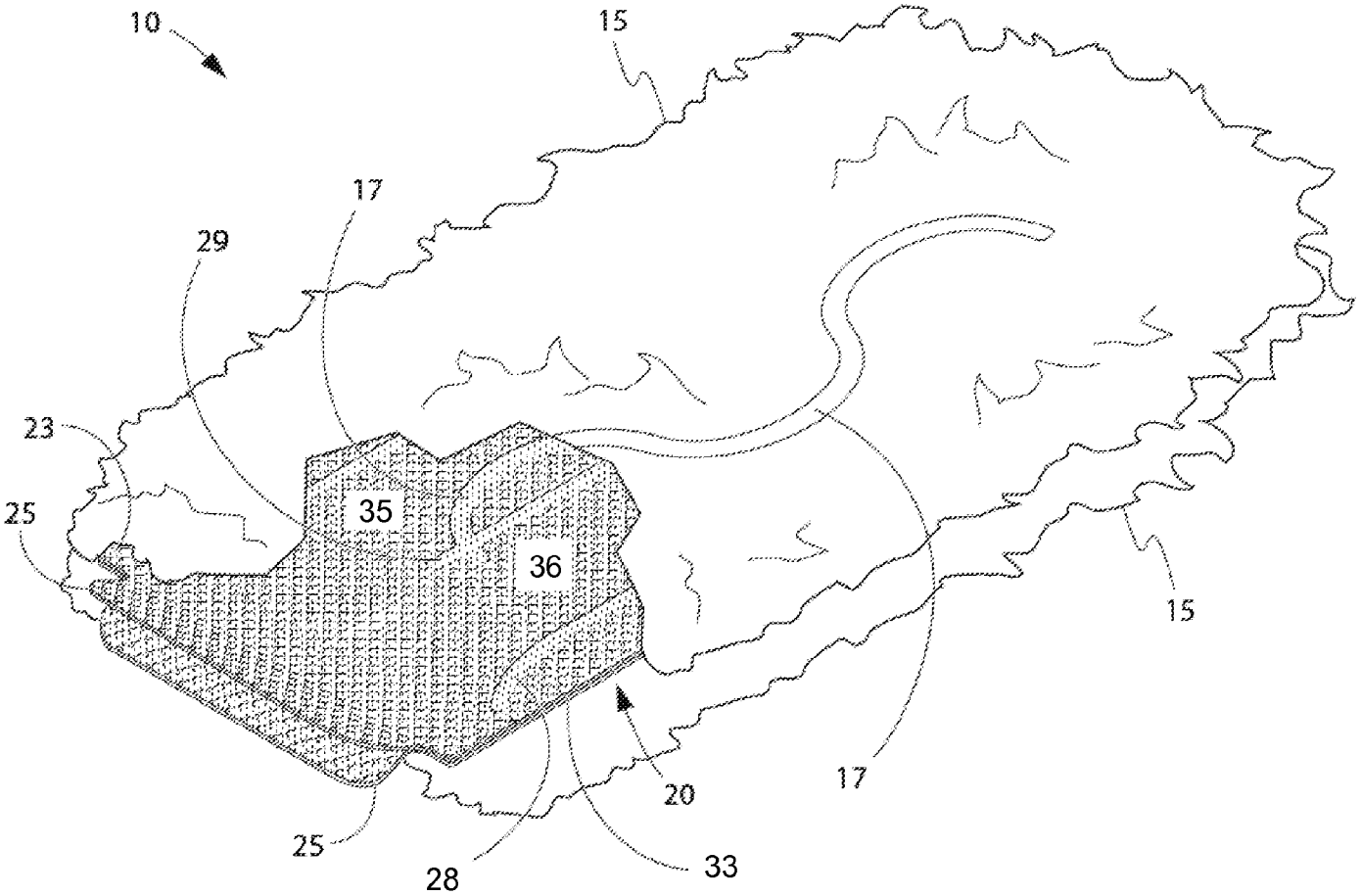
FIG. 5 is a perspective view with a portion of the upper fibrous bundle removed to show another technique for attaching the bundle to the sleeve.
Figure 6:
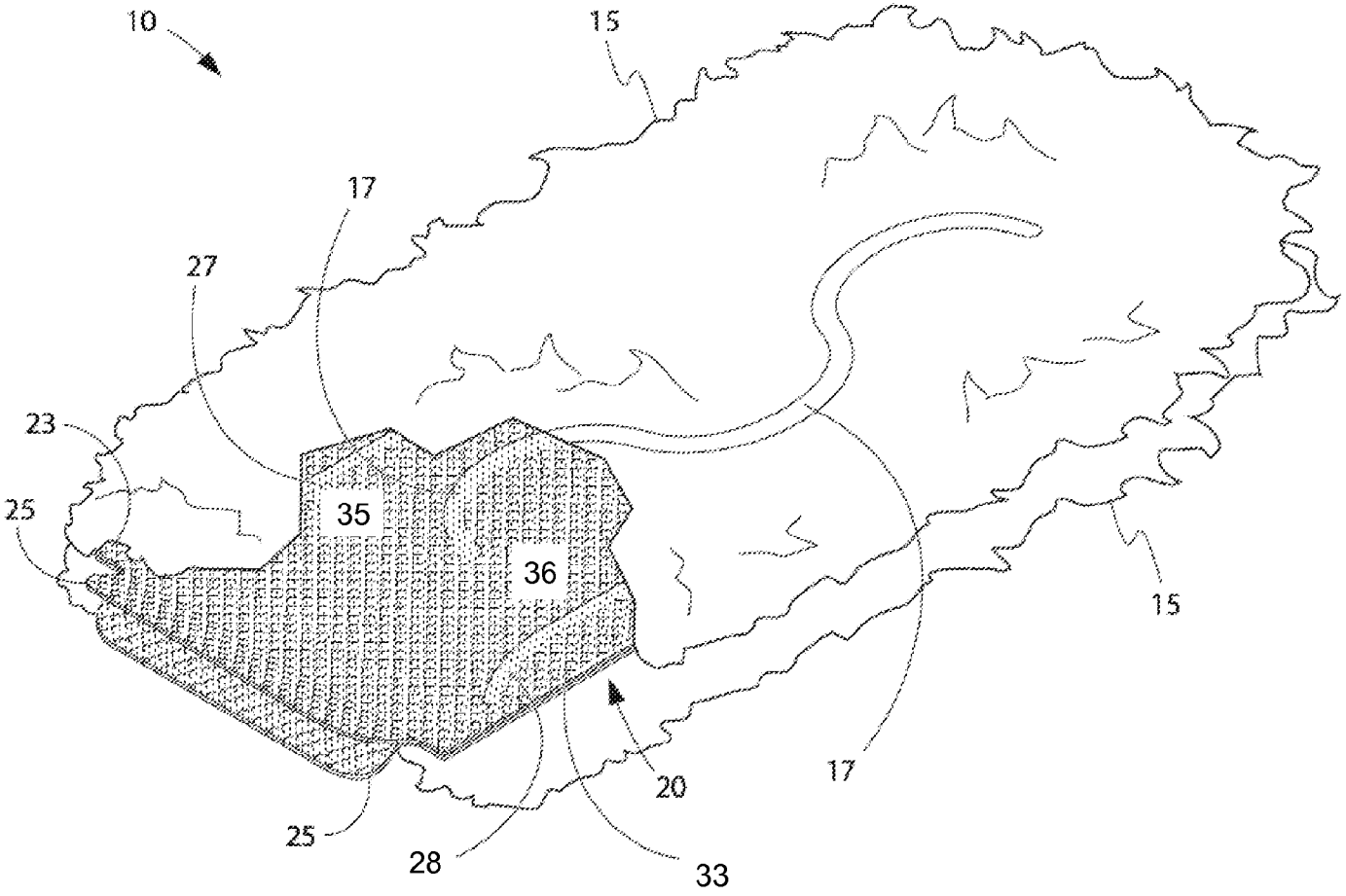
FIG. 6 is a perspective view of yet another embodiment of the 360-degree duster.

FIG. 5 is a perspective view with a portion of the upper fibrous bundle removed to show another technique for attaching the bundle to the sleeve. In the illustrated embodiment, the weld 17 is shown as extending through the fibrous bundle 15 and through the sleeve 20. One advantage of this technique is that the sinusoidal weld 17 creates narrowing areas in channels 35 and 36 that facilitate holding or securing the prongs of the handle in the interior of the sleeve 20. It should be appreciated that although the weld 17 is shown as being substantially sinusoidal, other embodiments are also anticipated, such as a saw tooth weld, and arch, an elliptical shape, straight line, broken line, tack welds, sinusoid with varying number of peaks and valleys, as well as other structures. It will further be appreciated that the advantage obtained by narrowing areas within the channels 35 and 36 can be created using any of a variety of these techniques, as well as other techniques and combinations thereof FIG. 6 is a perspective view of yet another embodiment of the 360-degree duster. In this embodiment, the weld 17 is shown as securing the fibrous bundles 15 to the sleeve 20 and extending through the sleeve 20. In this embodiment, the center weld 29 is shown as being eliminated and the weld 17 operates to create the channels 35 and 36.

Figure 7:
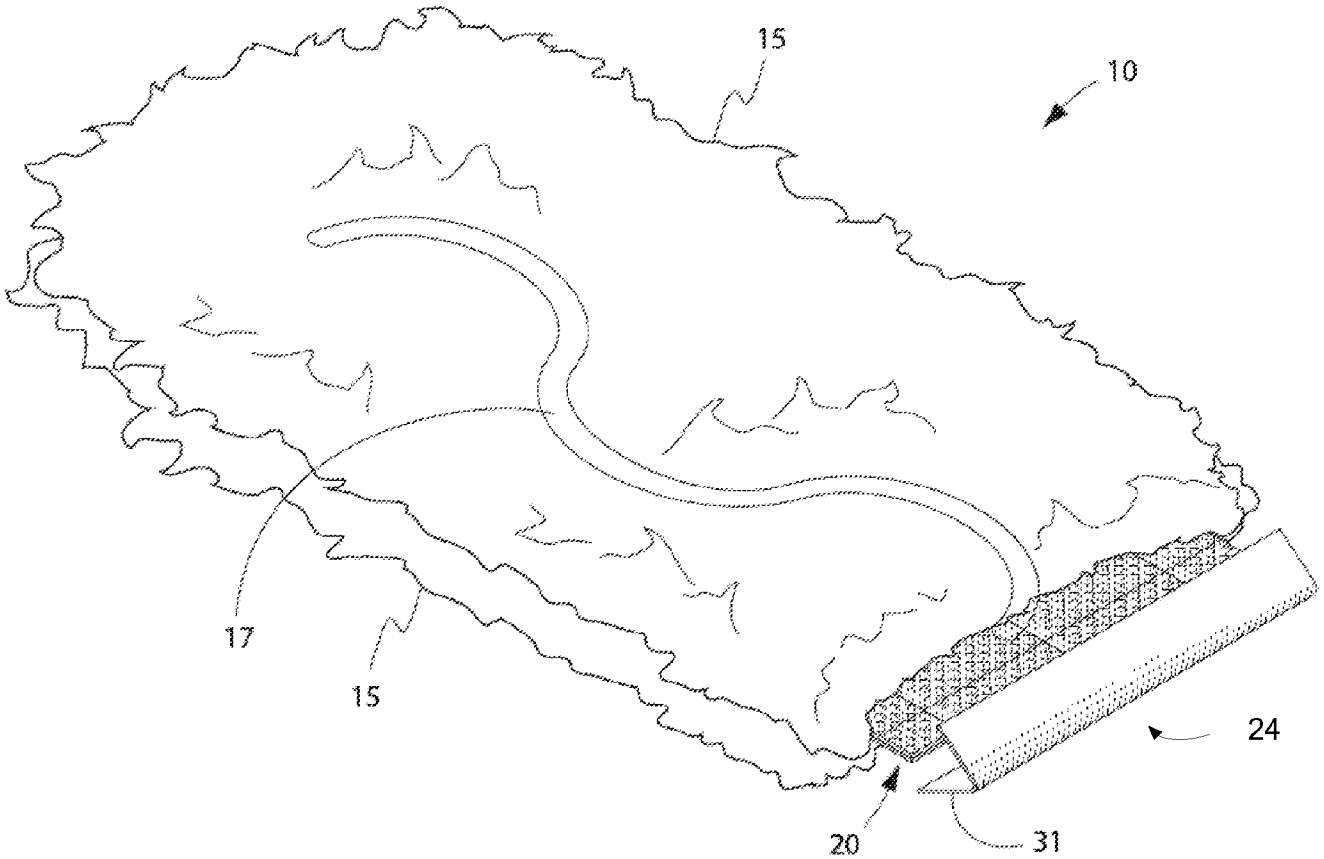
FIG. 7 is a perspective view of another embodiment of a 360-degree duster.
Figure 8:
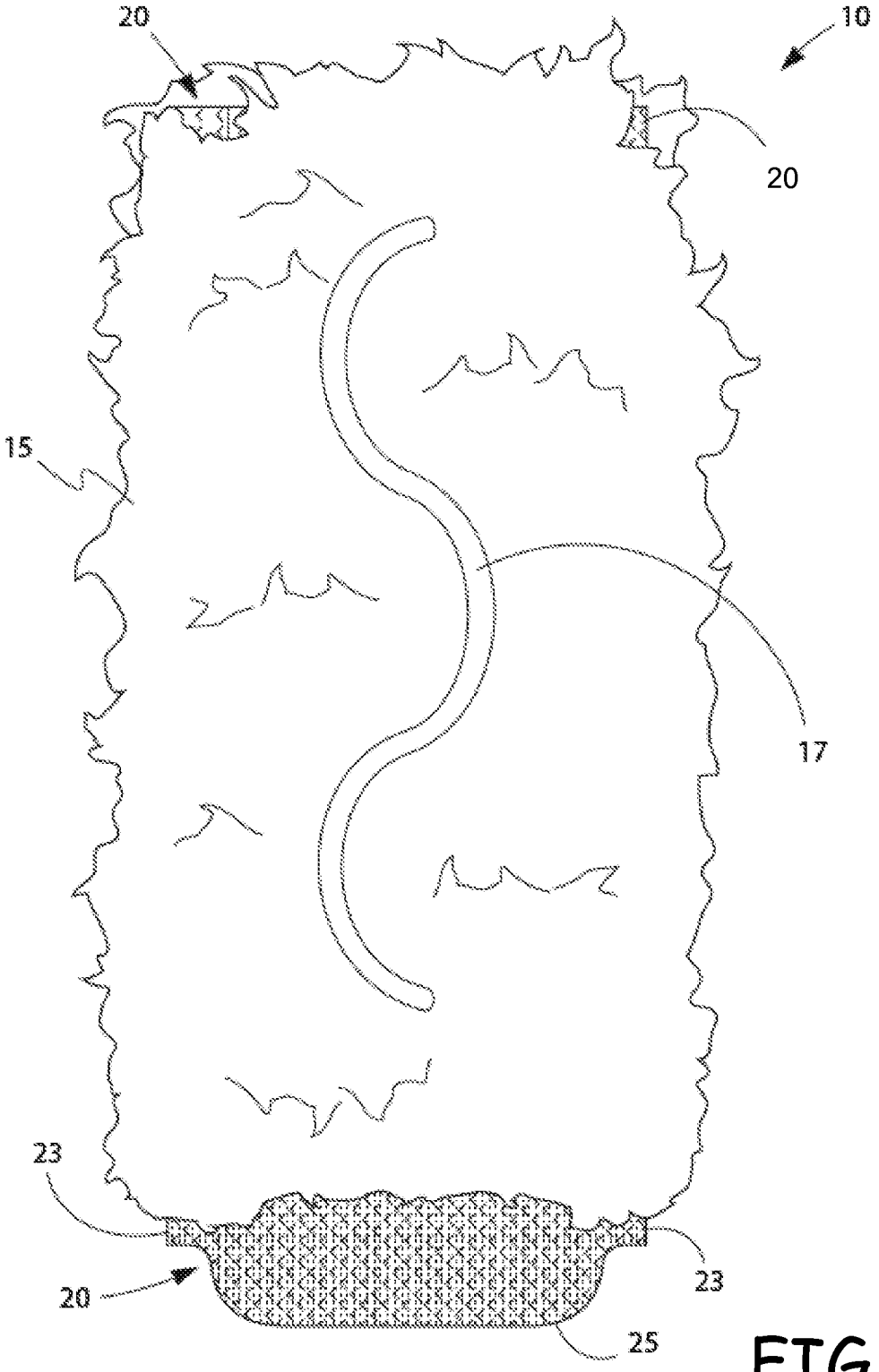
FIG. 8 is a top view of the 360-degree duster with the bottom view being a mirror image.
Figure 9:
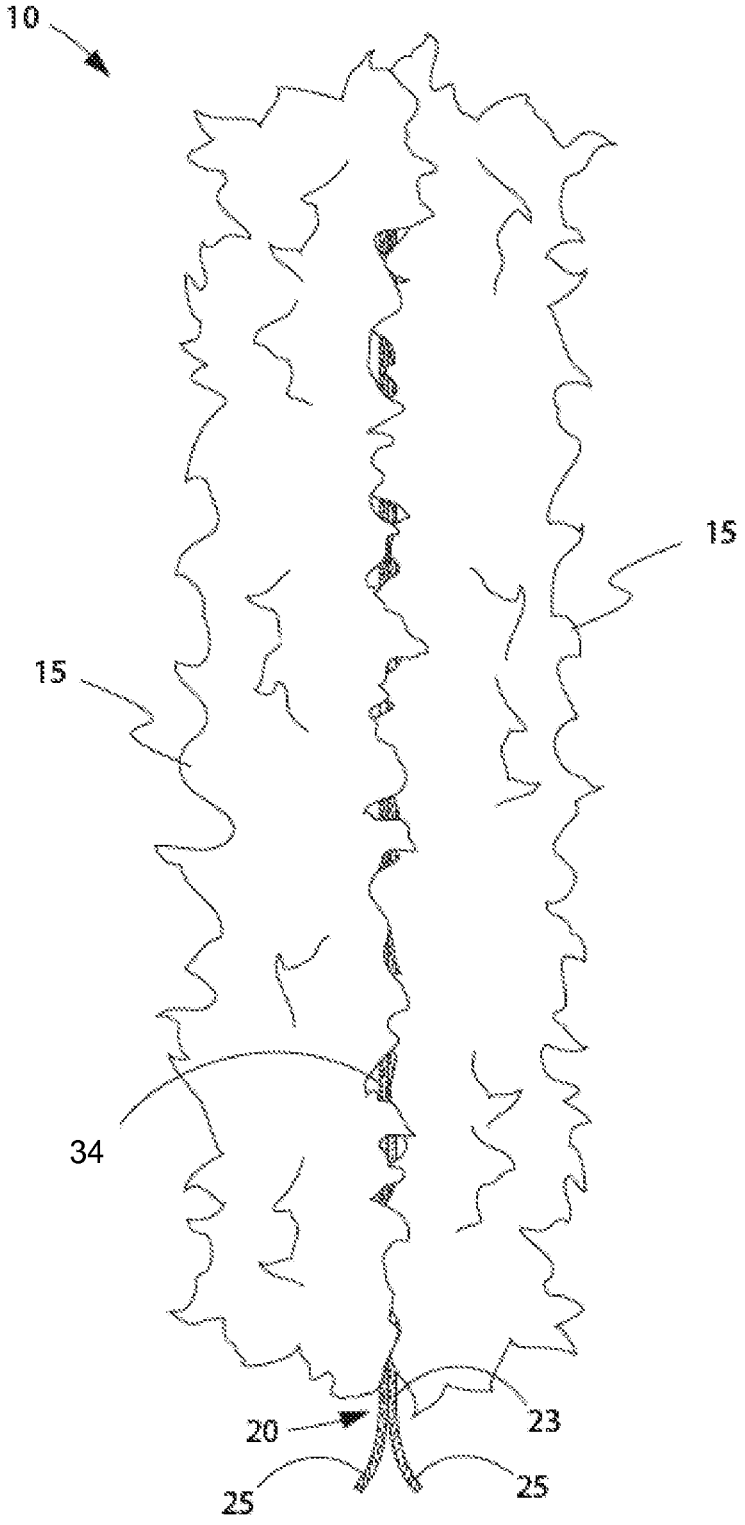
FIG. 9 is a side view of the 360-degree duster.
Figure 10:
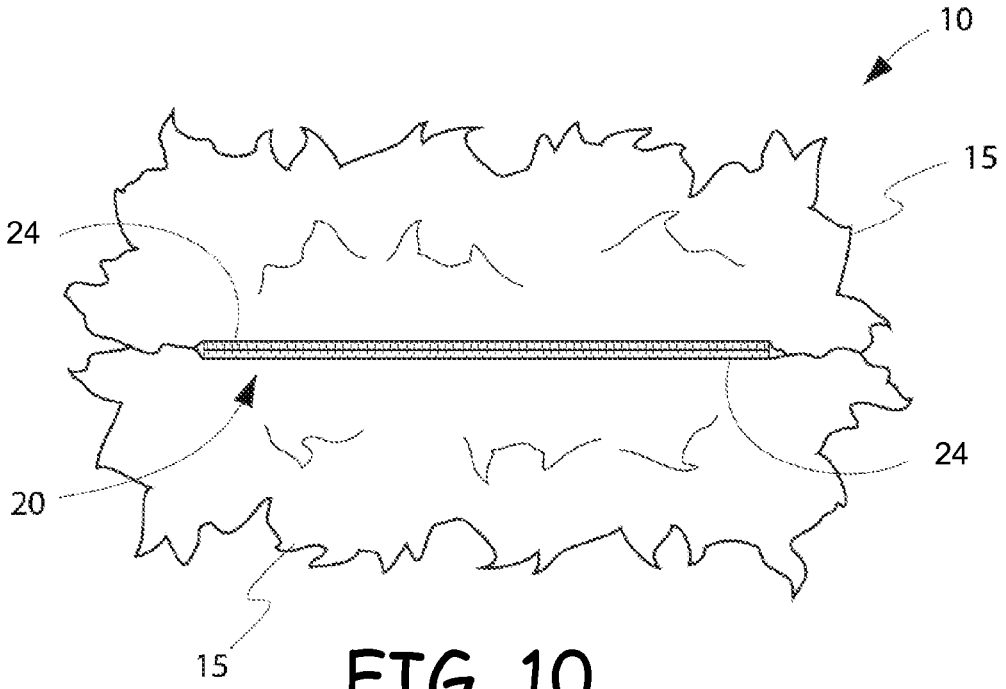
FIG. 10 is an end view showing the closed end of the 360-degree duster.
Figure 11:
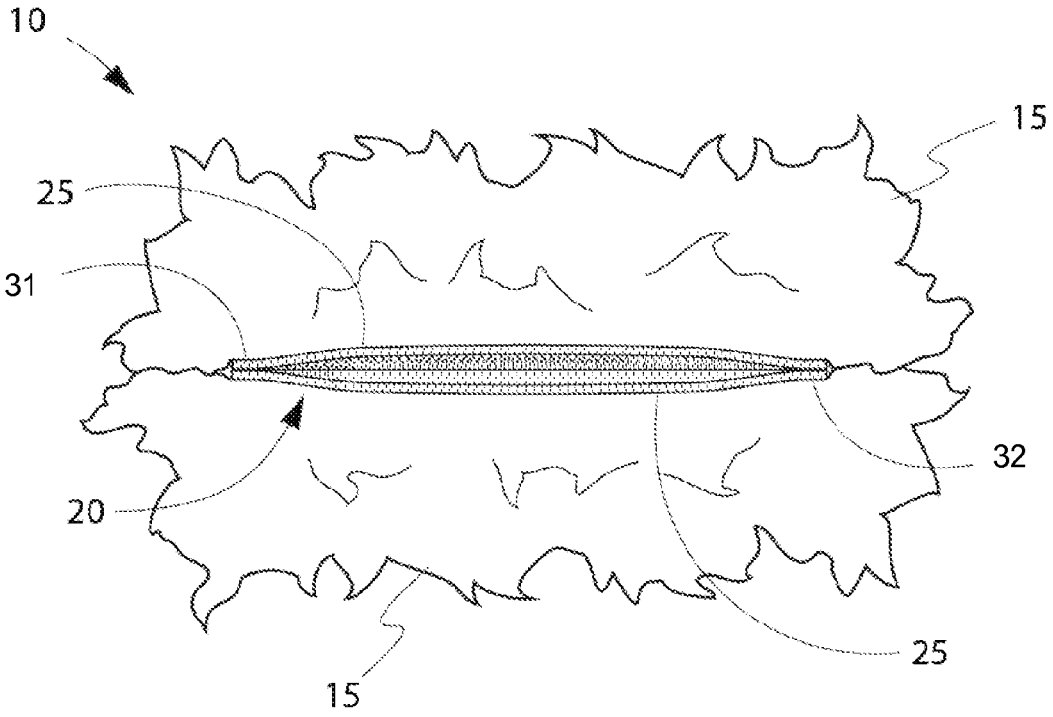
FIG. 11 is an end view showing the receiving end of the 360-degree duster.

FIG. 7 is a perspective view of another embodiment of a 360-degree duster. In this embodiment, the closed end 24 of the sleeve 20 is illustrated as being further secured by a strip 31 that is folded over the closed end 24 and joined to the closed end 24 using any of the variety of techniques presented above, as well as other techniques and combinations thereof FIG. 8 is a top view of the 360-degree duster with the bottom view being a mirror image. FIG. 9 is a side view of the 360-degree duster. FIG. 10 is an end view showing the closed end of the 360-degree duster. FIG. 11 is an end view showing the receiving end of the 360-degree duster.

In various embodiments, especially with regards to the 360-degree duster embodiments, a user may have difficulty identifying the receiving end 23 of the sleeve 20. As such, one aspect that may be incorporated into various embodiments of the duster is the use of elements of different or contrasting colors to help facilitate use of the duster. The degree of difference or contrast between the colors can vary an in essence, any variation may suffice as long as it is a noticeable variation to the typical naked eye. For example, in one embodiment the fibrous bundles 15 may be one color but one or more of the sheets of the sleeve 20 may be of a different color. As a non-limiting example, the fibrous bundles 15 may be white while one or more sheets of the sleeve 20 can be blue. Advantageously, this aspect, which can be incorporated into various embodiments, helps a user to more readily identify the sleeve 20 and more particularly, the receiving end 23 of the sleeve 20 so that the user can insert the prongs of the handle into the sleeve 20.

This aspect of the various embodiments may be implemented in a variety of manners. A few non-limiting examples include utilizing interior sheets of one color within the sleeve 20 and a different color for the exterior sheets and the fibrous bundles; dying or staining the flaps 25 a different color from the rest of the duster; including an insert into the sleeve that can be retracted either before, after or as the prongs are being entered into the sleeve; ensuring that the flaps 25 of the sleeve 20 extend beyond the boundary of the fibrous bundles; silk-screening or embossing words or indicia on the flap to indicate that the prongs should be entered on this end; and dying or staining the fibrous bundles near the receiving end a color that is different from the rest of the duster or, alternatively, bleaching either the closed end or receiving end to ensure that it is a different color from the other end and a different color from the fiber bundles.

Further, in the embodiment best illustrated in FIG. 7, the folded strip 31 may be of a different color from the sleeve 20 and/or fibrous bundles. This aspect, which may be incorporated into various embodiments, further facilitates the user being able to identify and distinguish the receiving end 25 of the sleeve 20 from the closed end 23.

In addition to using welds, such as weld 17 to attach the fibrous bundles 15 to the sleeve 20, the fibrous bundles may include a backing sheet (not illustrated), to which the fibrous bundles 15 are attached. The fibrous bundles 15 can be attached to the backing sheet using any of the above-described techniques as well as others. Further, the fibrous bundles and backing sheet assemblies can then be secured to the sleeve 20 using any of the above-described techniques, as well as other techniques. Further, the backing sheets of the fibrous bundles can actually be utilized as the sheets to form the sleeve. Alternatively or in addition, an adhesive material can be applied to the back of the fibrous bundles, such as a spray on adhesive to facilitate keeping the fibers together in a bundle.

The Sleeve

In the various embodiments, the sleeve 20 can be constructed using any of a variety of materials.

In one particular embodiment of the duster, the sleeve 20 can be constructed of multiple or single sheets of an air through bonded nonwoven material. The sheets can be constructed at a weight of 45GSM or in a range of 40-50GSM as a non-limiting example. The sheets may be porous or non-porous in various embodiments. As a non-limiting example, the sheets can be liquid-impervious, such as can be achieved using materials such as plastic, Mylar, silicon, etc.

In some embodiments, the sleeve may be constructed of two or more sheets that are attached to each other to form the sleeve or pocket. In general, the sheets can be of identical shape and size such that when laid on top of each other, the edges are in alignment. In such embodiments, the sheets can then be joined together along at least two opposing edges to allow an opening on the other two opposing ends. Further, the sheets can be joined along three edges leaving only an opening on one edge. In addition, the sleeves can be joined along three edges and a portion of the fourth edge to allow a limited sized opening on the fourth edge or, along two edges and a portion of the other two opposing edges to allow a limited sized opening on two ends of the sleeve. Further, the two sheets may be joined along the periphery of the sheets to totally enclose the pocket, and then one or more slits can be cut through one of the sheets to gain access to the interior.

Even further, the two sheets may be joined along the periphery except for two small openings on opposing edges. A single bar can be fed through this opening and then attached to opposite ends of a U shaped connector that may then be attached to a pole. In such an embodiment, the duster may be utilized as a floor duster and the topside and bottom side of the duster can be used depending on the position of the duster being rotated around the rod. In such embodiments, a stiffening material can also be included on the interior of the duster to facilitate rigidity of the duster. In a similar embodiment, an insert maybe placed on the interior of the sleeve, such as a plastic plate that includes receiving elements on one end or opposing ends for receiving a connecting device at the end of a mop pole. For instance, the plastic insert may include one or two flanges with apertures and a device, similar to a paint roller device with a single rod on the end can be inserted through openings in the sleeve and through the apertures thereby allowing the device to control the duster. Again, the duster can be rotated around the rod so that both sides of the duster may be utilized. It should be appreciated that these variations may be applied in any of the other disclosed embodiments as well as anticipated embodiments of the sleeve.

In addition, the sleeve may be constructed of two sheets having different sizes. In such an embodiment, the edges of the larger sheet can be folded over the edges of the smaller sheet and then joined together with the smaller sheet. Similarly, the sheets may be of different shapes. In such embodiments, one or more edges of a first sheet can be folded over the second sheet, and one or more edges of the second sheet can be folded over the first sheet and then joined together.

It should be appreciated that although the illustrated embodiments present a substantially rectangular shaped sleeve and duster, various embodiments may utilize a square shape, triangular shape, rounded shape, circular shape as well as other shapes and variants thereof. In addition, although the figures depict a substantially rectangular and flat profile for the duster, the width of the sleeve can be reduced to a size just sufficient to accommodate the one or more prongs of the handle and as such, have a more general tubular profile.

In other embodiments, the sleeve can be constructed from a single sheet that is folded over itself, and then one or more of the edges can be joined together to form the sleeve or pocket. Similar to the other embodiments, several configurations for joining the edges can be utilized to create a sleeve that can receive the handle on two ends, one end, have a opening with a limited size, etc. Even further, the sleeve may include multiple layers of different materials to provide strength or firmness to the duster cloth. Yet even further, the sleeve may be constructed of a single cloth tube, similar to a sock, that may then be closed on one side to form the sleeve or remain open on both sides.

The Fibrous Bundles

The fibrous bundles 15 can be constructed of a variety of materials and in a variety of manners. A few non-limiting examples of such construction are provided herein.

In one embodiment, the fibrous bundles 15 may be constructed of spunlace strands that can be twisted or crossed-over and laid side by side and on top of each other to form a bulky fibrous bundle. The fibers can be of uniform length and diameter or, the length and diameters may vary. In another embodiment, the fibrous bundles 15 may be constructed of a spunlace nonwoven embossed material. The fibrous bundles 15 can be constructed at a weigh of 70GSM or in a range of 60-80GSM as a non-limiting example. However, other embodiments may utilize a spun bonded nonwoven fabric, a suction nonwoven fabric, a heat bonded nonwoven fabric, a melt blown nonwoven fabric and the like, as a few non-limiting examples. A non-limiting example of fibrous bundle 15 may include a fibrous material, which provides enhanced dust absorbing characteristics and anti-wear properties. Further, in the embossed martial embodiments, the sheet may be cut into strips extending from near the center of the sheet to the outer edge of the sheet. The strips can be of uniform or varying lengths, and include a single sheet or multiple sheets that are overlaid.

The composition for composing the fibrous bundles and sleeve can be selected depending on the bonding method. For instance, if the duster is formed by heat sealing, then the various components may be constructed of a polyethylene terephthalate (PET) fiber, for example, or a non-woven fabric made of a PET/polyethylene (PE) (core/sheath) composite fiber. These non-woven fabrics are preferably obtained by subjecting a polypropylene (PP) fiber to water needling through a PP net having a lattice shape arrangement.

In other embodiments, the fibers can be threaded through a backing sheet and bonded to the opposing side of the backing sheet. In yet other embodiments, the fibers may be looped through the backing sheet such that both ends of the fiber extend from the same side of the backing sheet. The looped portion of the fiber can then be joined to the opposing side of the backing sheet using any of the previously described techniques. Further, rather than a backing sheet, any of these configurations may also be applied to the sheets of the sleeve 20. Further, the fibers can be threaded through the entire sleeve such that opposing ends of the fiber extend from opposing sides of the sleeve.

As previously mentioned, the duster can be constructed in the 360-degree embodiment with fibrous bundles on each side or, in other embodiments with fibrous bundles on only one side. Further, fibrous bundles of one type can be included on one side, but of a different type on the other side. For instance, one side of the duster may be more rigid in structure to facilitate a scrubbing function while the other side includes more flexible fibers for dusting. Similarly, the fibrous bundle on one side may be more densely bundled than on the other side. Further, the fibrous bundle on one side may extend from one outer edge to the other outer edge of the sleeve but on the other side, only extend partially across the sleeve (such as from the middle and half-way to the edge, or from the edge, half-way to the middle as non-limiting examples. The portions of the sleeve that do not include the fibrous bundle may be left open or include other materials, such as abrasive materials that can be used to scrub heavily soiled areas. In addition, a single fibrous bundle can be used in various embodiments by wrapping the fibrous bundle around the entire sleeve. As a non-limiting example, one edge of the bundle may be joined near the center of a first side of the sleeve, folded over the edge of the sleeve, traverse across the surface of the second side of the sleeve, folded back over the edge of the sleeve and traverse across the surface of the first sleeve to the other side of the bundle. Such a configuration may also utilize fibers of different lengths to ensure that each side of the sleeve has a substantial number of fiber ends that are used to move and collect dust. Likewise, such embodiments may utilize fibers of varying materials, thicknesses and lengths to create a duster that is applicable for a variety of situations.

Figure 12:
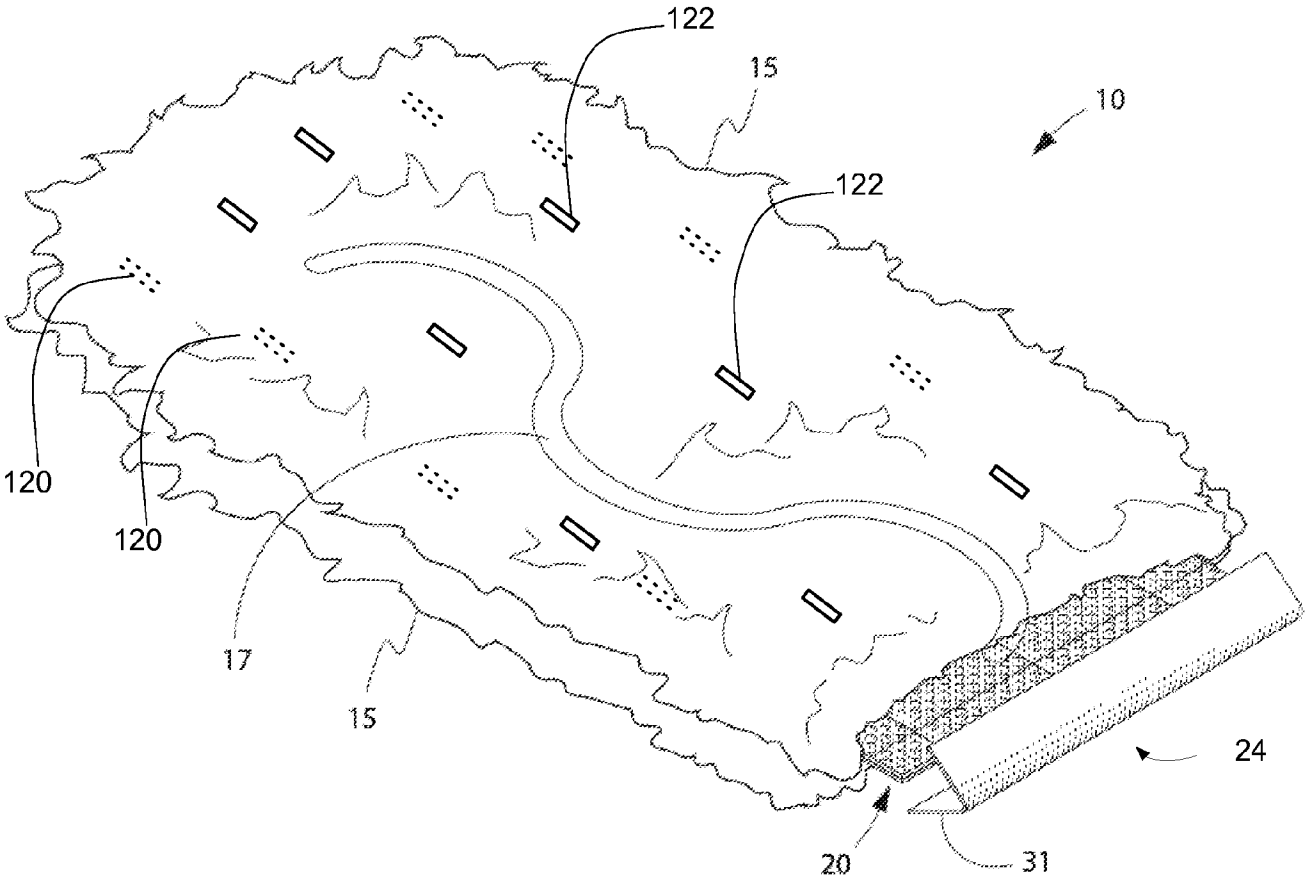
FIG. 12 illustrates an embodiment of the duster utilizing various joints or tack welds to attach the fibrous bundle to the sleeve and to facilitate separation of the various fibers.

The fibrous bundles may be attached to the surface of the sleeve in a manner to facilitate separation of the various fibers within the bundles. FIG. 12 illustrates an embodiment of the duster utilizing various joints or tack welds to attach the fibrous bundle to the sleeve and to facilitate separation of the various fibers. In the illustrated embodiment, tacks 120 connect a portion of the fibers at one depth to the sleeve 20. Further, tacks 122 connect different portions of the fibers at a different depth to the sleeve 20. Advantageously, this aspect causes the ends of the fibers within the fibrous bundles to traverse to different areas of the sleeve 20 before they are free to extend from the surface of the sleeve 20. As a result, the ends of the fibers are forced to be distributed over the surface of the sleeve 20.

Duster Handle.

In any of the aforementioned embodiments, as well as other embodiments, the duster can be mounted to a cleaning implement such as a handle, broom, mop head, etc. Thus, the duster 10 could be attached to a handle, broom or other cleaning implement that includes one or more prongs that can be inserted into the sleeve of the duster. It will be appreciated that while the various embodiments that have been illustrated as including two channels for receiving a two-pronged handle, other embodiments are also anticipated. As a non-limiting example, three channels can be created for receiving a three-pronged handle. Likewise, a single channel can be created for receiving a single-prong handle. Further, in the single prong handle embodiment, the prong may be wide and flat to prevent rotation of the duster during use.

Figure 13A:
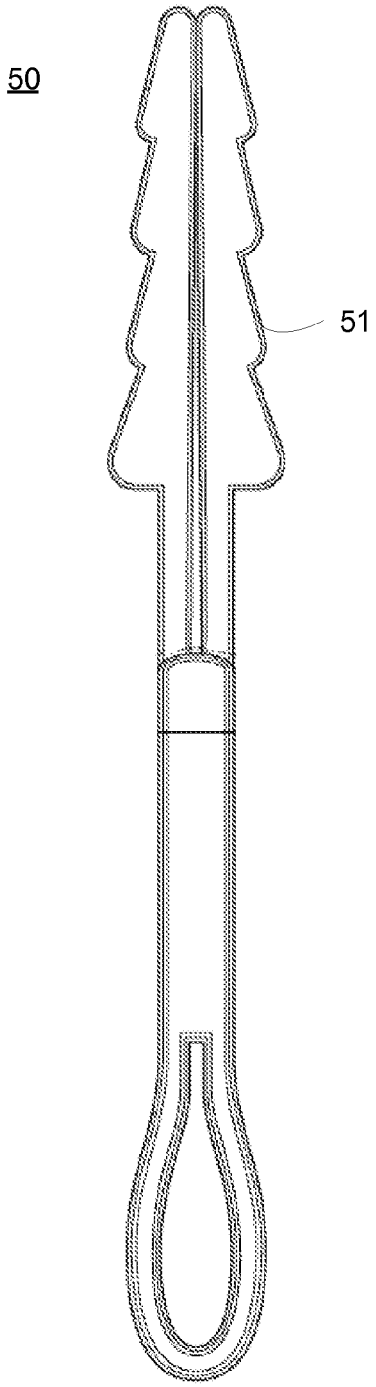
FIG. 13A and FIG. 13B show one non-limiting example of a duster handle that can be used in various embodiments of the duster.
Figure 13B:
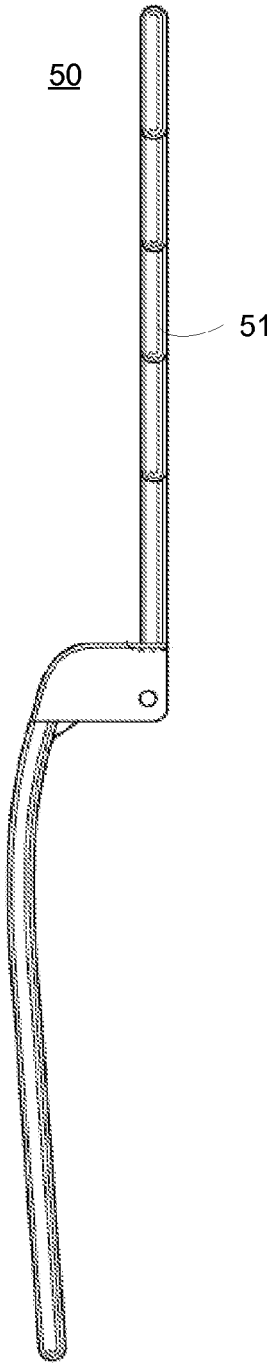
Figure 14A:
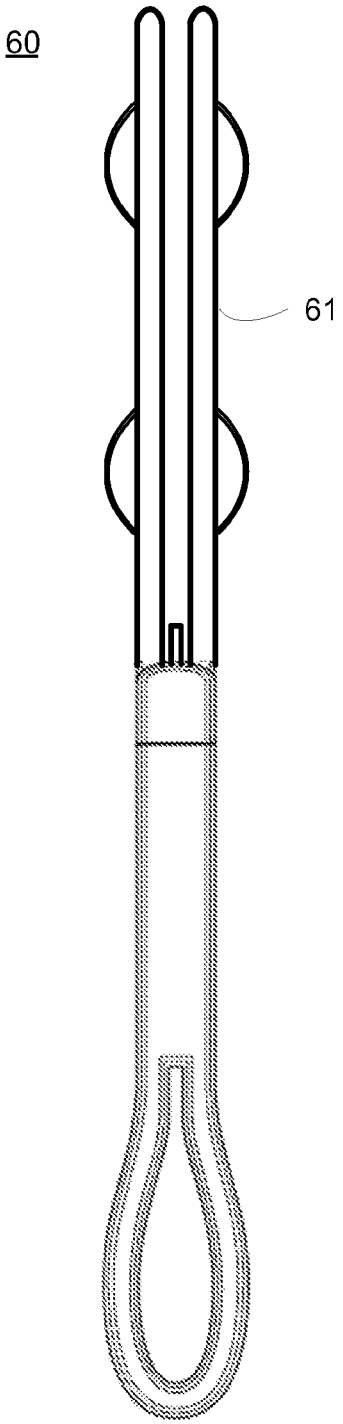
FIG. 14A and FIG. 14B illustrate another non-limiting example of a duster handle that can be used in various embodiments of the duster.
Figure 14B:
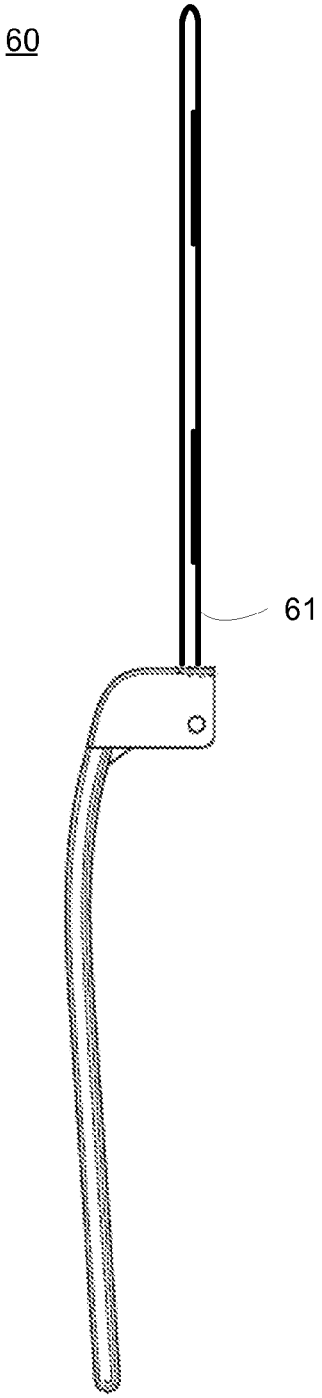

FIG. 13A and FIG. 13B show one non-limiting example of a duster handle that can be used in various embodiments of the duster. The duster handle 50 includes two prongs that can be inserted into the receiving end 23 of the sleeve 20. FIG. 14A and FIG. 14B illustrate another non-limiting example of a duster handle that can be used in various embodiments of the duster. The duster handle 60 includes two prongs that can be inserted into the receiving end 23 of the sleeve 20. It should be appreciated that the fusion welds applied to the sleeve, as well as the other listed techniques and combinations thereof for joining the sheets of the sleeve 20 together, could be structured to be particularly suitable for the style of prong that is to be inserted into the sleeve 20. Likewise, a generic structure could be set up to receive a variety of prong types, shapes and sizes.

For instance, to specifically conform to the tapered tooth structure of prongs 51, the joining technique may include narrowing indentations in the channels 35 and 36 of the sleeve 20 such that the peaks of the teeth may correspond with, or fall just beyond the narrowed sections. Similarly, to specifically conform to the arched structure of prongs 61, the joining technique may include narrowing indentations in the channels 35 and 36 of sleeve 20 such that the arches slide through the narrowed portions and are then held in place. To receive a variety of prong structures, the structures of the prongs may be analyzed to identify common catch points and then, the joining technique maybe structured such that at least one of the protrusions from each prong structure correspond with a narrowing area of the channels 35 and 36. It should also be appreciated that various embodiments may not use any narrowing techniques for the channels 35 and 36 and simply rely on friction to hold the prongs of the handle in place. Further, the prongs of the handle can be specifically structured to increase the friction between the surface of the prong and the interior surface of the sleeve. The friction can be increased using a variety of techniques. One non-limiting example to increase the friction between the prongs of the handle and the interior surface of the sleeve is to apply an adhesive or a sticky substance to the surface of the prong, the interior surface of the sleeve, or both. Another non-limiting example to increase the friction between the prongs of the handle and the interior surface of the sleeve is to utilize prongs with a roughened texture.

Figures 15, 15A:
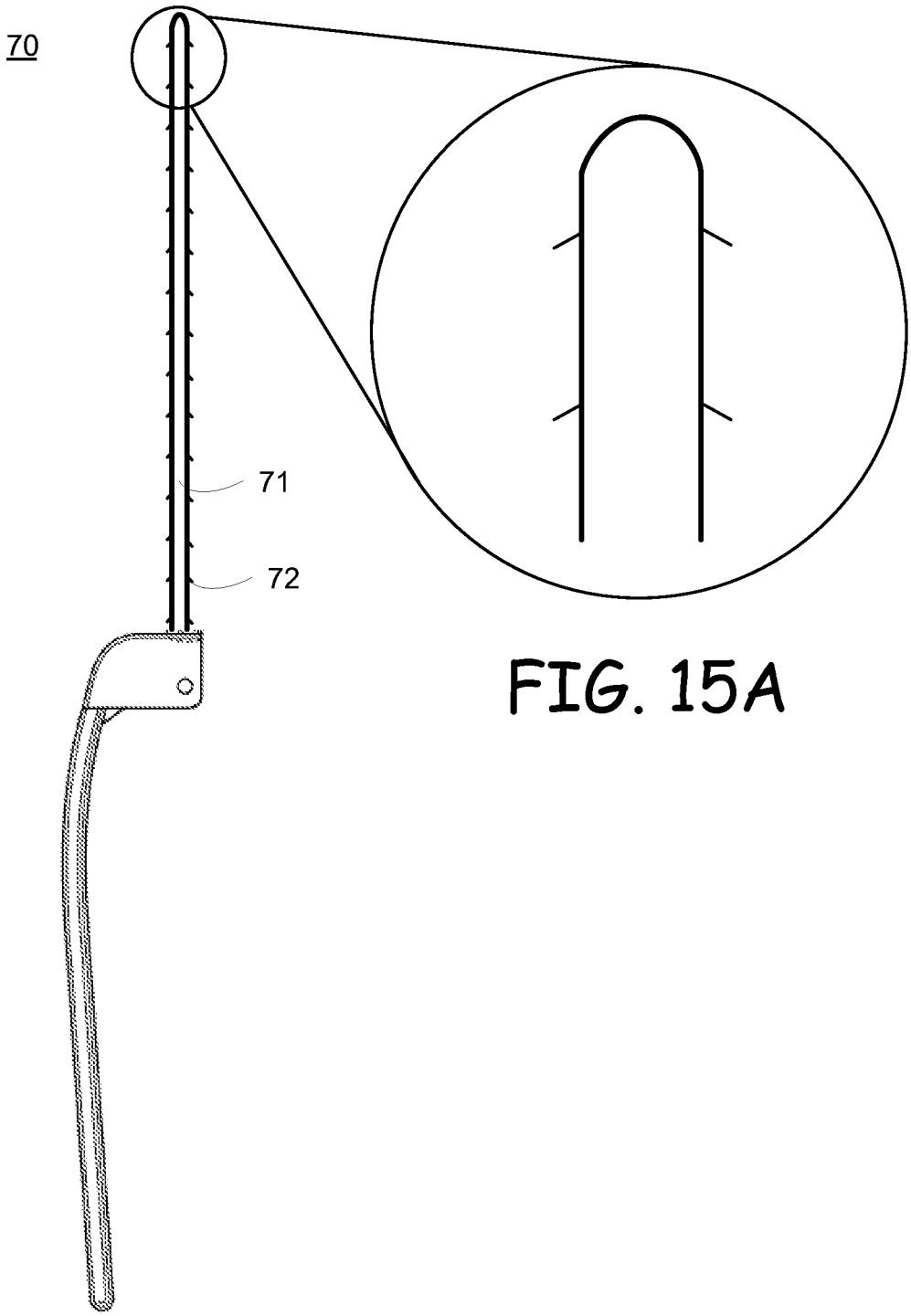
FIG. 15 illustrates yet another non-limiting example to increase the friction between the prongs of the handle and the interior surface of the sleeve.
FIG. 15A illustrates a magnified portion of the embodiment of FIG. 15.

FIG. 15 illustrates yet another non-limiting example to increase the friction between the prongs of the handle and the interior surface of the sleeve. In the illustrated example, the surface of the prongs 71 of the duster handle 70 include a series of small teeth 72 that can be either molded into the prong or can be created by cutting and lifting a portion of the prong surface. FIG. 14A illustrates a magnified view of the teeth 72 on the prong 71. Similarly, bumps or other protrusions could also be utilized to achieve a similar increase in friction. In other embodiments, the prongs can be structure to provide a pinching force to hold the prongs within the interior of the sleeve 20. For instance, the prongs may be configured such that when inserted into the sleeve, the prongs are forced to separate from each other by moving in opposing directions. The material utilized to create the prongs may include a level of elasticity such that when separated as described, they apply an inward force against a center interior weld or other joining technique of the sleeve and thus, applying a pinching force. Similarly, the prongs may be configured to have a larger gap between them such that when they are inserted into the channels of the sleeve, they are forced towards each other. Again, by constructing the prongs with a level of elasticity, they would then apply a force against exterior welds or other joining techniques of the channels of the sleeve and thus hold the prongs within the sleeve interior.

Further, rather than including protrusions on the exterior edges of the prongs as illustrated in FIG. 13A and FIG. 14A, the prongs may include interior protrusions that can correspond with channel narrowing areas created by the central weld or other joining technique applied to the sleeve. For example, with reference to the sinusoidal weld in FIG. 6, the interior edge of the prongs may include protrusions that would correspond with the widened channel areas created by the sinusoidal weld such that the protrusions are just beyond a narrowing area and thus held in place. It will be appreciated that other techniques as well as combinations of the presented techniques with each other or the additional techniques is also anticipated and one of ordinary skill in the art will be familiar with utilizing such techniques or combinations.

Figure 16:
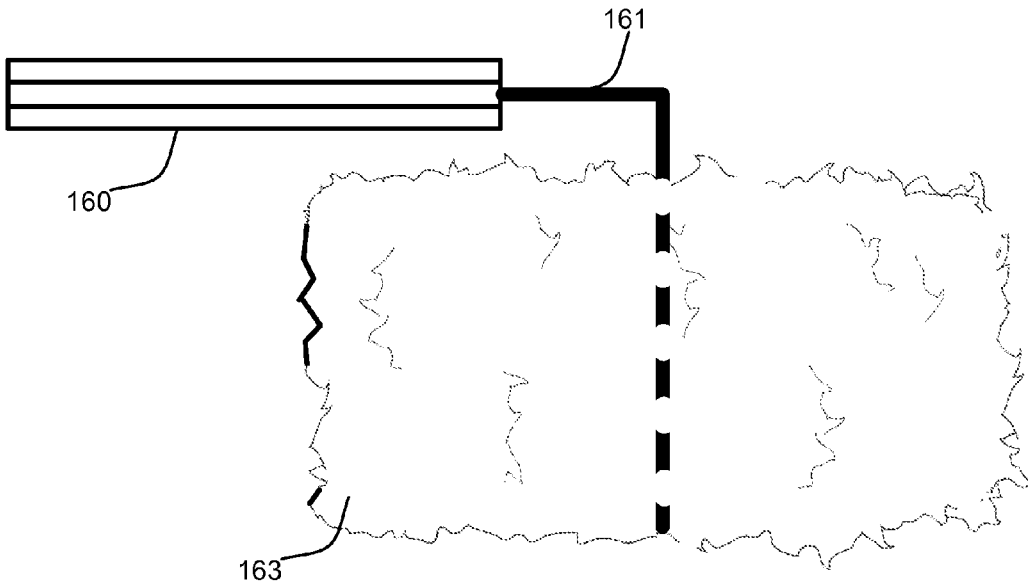
FIG. 16 is a conceptual diagram of the previously mentioned embodiment of the duster adapted to be utilized by a handled device that includes a single rod that passes through the sleeve and allows the duster to be manipulated and to rotate around the rod.

FIG. 16 is a conceptual diagram of the previously mentioned embodiment of the duster adapted to be utilized by a handled device that includes a single rod that passes through the sleeve and allows the duster to be manipulated and to rotate around the rod. The illustrated embodiment includes a handle 160, and extending rod 161 and an axis rod 162 that extends into the interior of the duster 163 sleeve and is secured by any of a variety of techniques.

Figure 17:
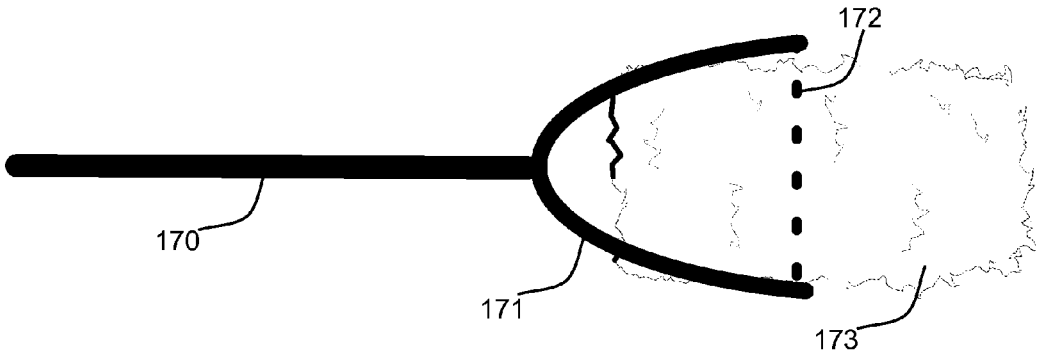
FIG. 17 is another conceptual diagram illustrating the previously mentioned embodiment of the duster used with a mop handle.

FIG. 17 is another conceptual diagram illustrating the previously mentioned embodiment of the duster used with a mop handle. The mop handle 170 includes a U-shaped or other shaped connector 171 that receives a rod 172 that may be passed through the interior of the duster 173. Again, in this embodiment the duster 173 may pivot around rod 172 and thus allow both sides of the duster to be utilized.

Other embodiments and configurations of handles or devices to connect to the duster are also anticipated.

In the description and claims of the present application, each of the verbs, "comprise", "include" and "have", and conjugates thereof, are used to indicate that the object or objects of the verb are not necessarily a complete listing of members, components, elements, or parts of the subject or subjects of the verb.

The present invention has been described using detailed descriptions of embodiments thereof that are provided by way of example and are not intended to limit the scope of the invention. The described embodiments comprise different features, not all of which are required in all embodiments of the invention. Some embodiments of the present invention utilize only some of the features or possible combinations of the features. Variations of embodiments of the present invention that are described and embodiments of the present invention comprising different combinations of features noted in the described embodiments will occur to persons of the art.

It will be appreciated by persons skilled in the art that the present invention is not limited by what has been particularly shown and described herein above. Rather the scope of the invention is defined by the claims that follow.

What is claimed is:

1. A duster comprising:

a sleeve constructed of at least two sheets of overlapping material and including at least one top sheet and at least one bottom sheet and defining a space there between;

a top fibrous bundle attached to an exterior surface of the top sheet by at least a first non-linear joint that extends through the top fibrous bundle and adheres to the exterior surface of the top sheet of the sleeve;

a bottom fibrous bundle attached to an exterior surface of the bottom sheet by at least a second non-linear joint that extends through the bottom fibrous bundle and adheres to the exterior surface of the bottom sheet of the sleeve;

a center joint joining the at least one top sheet and the at least one bottom sheet of the sleeve together, the center joint extending longitudinally down and substantially centered on the sleeve; and at least two side joints further joining the at least one top sheet and the at least one bottom sheet of the sleeve together, the at least two side joints extending longitudinally down and offset from the center of the sleeve to create at least two channels between the at least one top sheet and the at least one bottom sheet of the sleeve, and wherein the two side joints flare away from the center joint to widen the channels proximate to an opening of the channels.

2. The duster of claim 1, further comprising a means for further attaching the top fibrous bundle to the exterior surface of the top sheet and a means for further attaching the bottom fibrous bundle to the exterior surface of the bottom sheet to cause a separation of various fibers within the fibrous bundles.

3. The duster of claim 1, wherein the means for further attaching the top fibrous bundle and the bottom fibrous bundle includes one or more tacking joints.

4. The duster of claim 1, wherein the means for further attaching the top fibrous bundle and the bottom fibrous bundle includes an adhesive.

5. The duster of claim 1, wherein the at least two sheets comprise at least two separate sheets.

6. The duster of claim 1, wherein the at least two sheets comprise at least one single sheet that is folded over itself.

7. The duster of claim 1, wherein the at least two sheets define a flaps at an end of the sleeve proximate to the opening of the channels, wherein the flaps extend beyond the first and second non-lineal joint.

8. The duster of claim 7, wherein the flaps are a different color from the at least one top and at least one bottom sheets.

9. The duster of claim 7, wherein the flaps are a different color from the top and bottom fibrous bundles.

10. The duster of claim 7, wherein the flaps are a different color from the at least one top and at least one bottom sheets and the top and bottom fibrous bundles.

11. The duster of claim 7, wherein the flaps are a different color from the at least one top and at least one bottom sheets.

12. The duster of claim 7, wherein the flaps are a different color from the top and bottom fibrous bundles.

13. The duster of claim 7, wherein the flaps are a different color from the at least one top and at least one bottom sheets and the top and bottom fibrous bundles.

14. A duster comprising:

a sleeve constructed of at least two sheets of overlapping material and including at least one top sheet and at least one bottom sheet and defining a space there between;

a top fibrous bundle attached to an exterior surface of the top sheet by at least a first joint that extends through the top fibrous bundle and adheres to the exterior surface of the top sheet of the sleeve;

a bottom fibrous bundle attached to an exterior surface of the bottom sheet by at least a second joint that extends through the bottom fibrous bundle and adheres to the exterior surface of the bottom sheet of the sleeve;

a center joint joining the at least one top sheet and the at least one bottom sheet of the sleeve together, the center joint extending longitudinally down and substantially centered on the sleeve; and at least two side joints further joining the at least one top sheet and the at least one bottom sheet of the sleeve together, the at least two side joints extending longitudinally down and offset from the center of the sleeve to create at least two channels between the at least one top sheet and the at least one bottom sheet of the sleeve, and wherein the two side joints flare away from the center joint to widen the channels proximate to an opening of the channels.

15. The duster of claim 1, further comprising a means for further attaching the top fibrous bundle to the exterior surface of the top sheet and a means for further attaching the bottom fibrous bundle to the exterior surface of the bottom sheet to cause a separation of various fibers within the fibrous bundles.

16. The duster of claim 1, wherein the means for further attaching the top fibrous bundle and the bottom fibrous bundle includes one or more tacking joints.

17. The duster of claim 1, wherein the means for further attaching the top fibrous bundle and the bottom fibrous bundle includes an adhesive.

18. The duster of claim 1, wherein the at least two sheets comprise at least two separate sheets.

19. The duster of claim 1, wherein the at least two sheets comprise at least one single sheet that is folded over itself.

20. The duster of claim 1, wherein the at least two sheets define a flaps at an end of the sleeve proximate to the opening of the channels, wherein the flaps extend beyond the first and second non-lineal joint.

* * * * *